US006628750B1

(12) United States Patent
Korenev

(10) Patent No.: US 6,628,750 B1
(45) Date of Patent: Sep. 30, 2003

(54) SYSTEM FOR ELECTRON AND X-RAY IRRADIATION OF PRODUCT

(75) Inventor: Sergey Alexandrovich Korenev, Mundelein, IL (US)

(73) Assignee: Steris Inc., Temecula, CA (US)

( * ) Notice: Subject to any disclaimer, the term of this patent is extended or adjusted under 35 U.S.C. 154(b) by 151 days.

(21) Appl. No.: 09/710,475

(22) Filed: Nov. 9, 2000

(51) Int. Cl.[7] ..... G21K 5/00
(52) U.S. Cl. ..... 378/64; 378/68; 250/453.11
(58) Field of Search ..... 250/453.11, 454.11, 250/455.11, 492.1, 492.3; 378/64, 68, 69, 92

(56) References Cited

U.S. PATENT DOCUMENTS

| | | | | | |
|---|---|---|---|---|---|
| 3,676,675 | A | * | 7/1972 | Ransohoff et al. | 378/69 |
| 3,780,308 | A | * | 12/1973 | Nablo | 250/492.3 |
| 4,484,341 | A | * | 11/1984 | Luniewski | 378/69 |
| 4,852,138 | A | * | 7/1989 | Bergeret et al. | 378/69 |
| 5,004,926 | A | * | 4/1991 | Vassenaix et al. | 250/492.3 |
| 5,396,074 | A | * | 3/1995 | Peck et al. | 250/453.11 |
| 5,400,382 | A | * | 3/1995 | Welt et al. | 378/69 |
| 5,661,305 | A | * | 8/1997 | Lawrence et al. | 250/397 |
| 5,847,401 | A | * | 12/1998 | McKeown et al. | 250/396 ML |
| 5,969,367 | A | * | 10/1999 | Hiramoto et al. | 250/492.3 |
| 5,994,706 | A | * | 11/1999 | Allen et al. | 250/454.11 |
| 6,028,532 | A | * | 2/2000 | Tsurumoto et al. | 340/825.53 |
| 6,177,677 | B1 | * | 1/2001 | Alboresi et al. | 250/453.11 |
| 6,191,424 | B1 | * | 2/2001 | Stirling et al. | 250/455.11 |
| 6,285,030 | B1 | * | 9/2001 | Williams et al. | 250/454.11 |
| 6,294,791 | B1 | * | 9/2001 | Williams et al. | 250/455.11 |
| 6,327,339 | B1 | * | 12/2001 | Chung et al. | 378/121 |
| 6,396,065 | B1 | * | 5/2002 | Kimura et al. | 250/453.11 |
| 6,429,444 | B1 | * | 8/2002 | Korenev et al. | 250/492.3 |
| 6,459,089 | B1 | * | 10/2002 | Masefield et al. | 250/453.11 |
| 6,463,123 | B1 | * | 10/2002 | Korenev | 378/69 |

FOREIGN PATENT DOCUMENTS

RU 1501829 9/1995

OTHER PUBLICATIONS

Iotron Industries Canada Inc. WebPage—printed Feb. 27, 2003 http://www.iotron.com Impella Accelerators –Fact Sheet/How It Works.

Lawrence, et al., "Real–Time Confirmation of Electron–Beam Dose", Radiat. Phys. Chem. vol 52, Nos 1–6, pp. 543–547 1998.

Korenev, "Design and Investigations of Pulsed High Current Electron and Ion Sources For Applied Tasks", Dissertation of Ph.D. in Engineering, 1994.

Svinin, "Calculation and Design of High Voltage Electron Accelerators For Radiation Technologies", 1989.

(List continued on next page.)

*Primary Examiner*—Drew A. Dunn
*Assistant Examiner*—Irakli Kiknadze
(74) *Attorney, Agent, or Firm*—Fay, Sharpe, Fagan, Minnich & McKee, LLP

(57) ABSTRACT

A rotary accelerator (10) accelerates electrons and discharges them through each of a plurality of discharge ports, electrons discharge from each port having a different energy. The electron beams are channeled to scan horns disposed to irradiate products (14) traveling on conveyers (12). More specifically, some of the scan horns are positioned in pairs with an upper scan horn (18) on one side of the product, and a lower scan horn (20) on an opposite side of the product. A beam splitter splits the electron beam alternately between the two scan horns. Alternately, two scan horns (18, 20) are both disposed on the same side of the product. As yet another alternative, a scan horn (60) is disposed horizontally to irradiate the product from the side. Optionally, one or more of the scan horns includes a x-ray target (26) for converting the electrons into x-rays.

20 Claims, 7 Drawing Sheets

OTHER PUBLICATIONS

Ware, et al. "Inductive–Energy Power Flow For X–Ray Sources", Proceedings vol I—Beams '96, 11$^{th}$ Int. Conf. on High Power Particle Beams Prague, Czech Republic—Jun. 10–14, 1996, pp. 284–289.

Sincerny, et al. "DECADE Design and Testing Status", Proceedings vol II—Beams '96, 11$^{th}$ Int. Conf. on High Power Particle Beams Prague, Czech Republic—Jun. 10–14, 1996, pp. 1003–1007.

Rhodotron TT 100 Advertising Brochure at least as early as early as 2000.

Kilert, et al. "Beam Power Absorption Devices", pp. 705–774 c. 1970.

Pottier, "A New Type of RF Electron Accelerator: The Rhodotron", Nuclear Instruments and Methods in Physics Research —1989 LET and RBE, Radiotherapy c. 1985.

Logistics of Electron Beam Composition Workshop.

* cited by examiner

SYSTEM FOR ELECTRON AND X-RAY IRRADIATION OF PRODUCT

BACKGROUND OF THE INVENTION

The present invention relates to the irradiation arts. It finds particular application in the field of product sterilization and will be described with particular reference thereto. However, it is to be understood that the present invention is also applicable to other applications and is not limited to the aforementioned application.

X-rays and electron beams have been found to be useful in the irradiation of products. This type of high energy radiation, in sufficient doses, destroys most all types of parasitic bacteria and viruses which have the potential of making people ill. This is useful for sterilizing food meant for consumption, as well as other products such as medical instruments. Of course, with x-rays and electron beams the product is free from residual radiation. High energy irradiation is used for numerous other applications including polymer modification, material treatment, and the like.

X-rays are high energy photons that are produced as a result of accelerated electrons interacting with a target. Both x-rays and electrons penetrate solid material, depositing energy along the way. In living organisms, these types of radiation interact with the tissue and can destroy it, or destroy its capability to reproduce, effectively destroying it. In polymers, the radiation breaks chemical bonds.

Electron beams are generally more effective than x-rays when destroying harmful organisms. Electrons have a higher linear energy transfer (LET) than x-rays. That is, they deposit significantly more energy per distance traveled. However, they do not penetrate as far as x-rays. Most of the electron energy is transferred near the surface of the product. Generally, effectiveness is traded for range or depth when going from electrons to x-rays. X-rays penetrate much deeper into objects but do not interact as much as electrons. Both modalities are useful, depending on the application.

The present invention provides a new and improved method and apparatus for the irradiation of product. The present invention presents a new method and apparatus that overcomes the above referenced problems and others.

SUMMARY OF THE INVENTION

In accordance with one aspect of the present invention, an irradiation treatment system is given. Multiple conveyers convey product through a region to be sterilized by radiation of varying energy levels. Multiple scan horns emit either x-rays or accelerated electrons into the product.

According to a more limited aspect of the present invention, a single accelerator supplies electrons to scan horns and x-ray targets of the system.

In accordance with another aspect of the present invention, a method of irradiation is given. Products are passed in parallel through a region to be sterilized. The products are scanned by beams of electrons as they pass.

According to another aspect of the present invention, a method of product sterilization is given. A product type is manually input into a product sterilization system, variables are determined to discern optimum performance of the system, and products are fed through the system.

One advantage of the present invention is that it supports a wide range of electron potentials.

Another advantage of the present invention is that it irradiates a wide variety of consumer products.

Another advantage of the present invention is that it has both electron beam and x-ray capability.

Yet another advantage of the present invention is that it requires only one electron accelerator.

Still further benefits and advantages of the present invention will become apparent to those skilled in the art upon a reading and understanding of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENT

Figure 1:
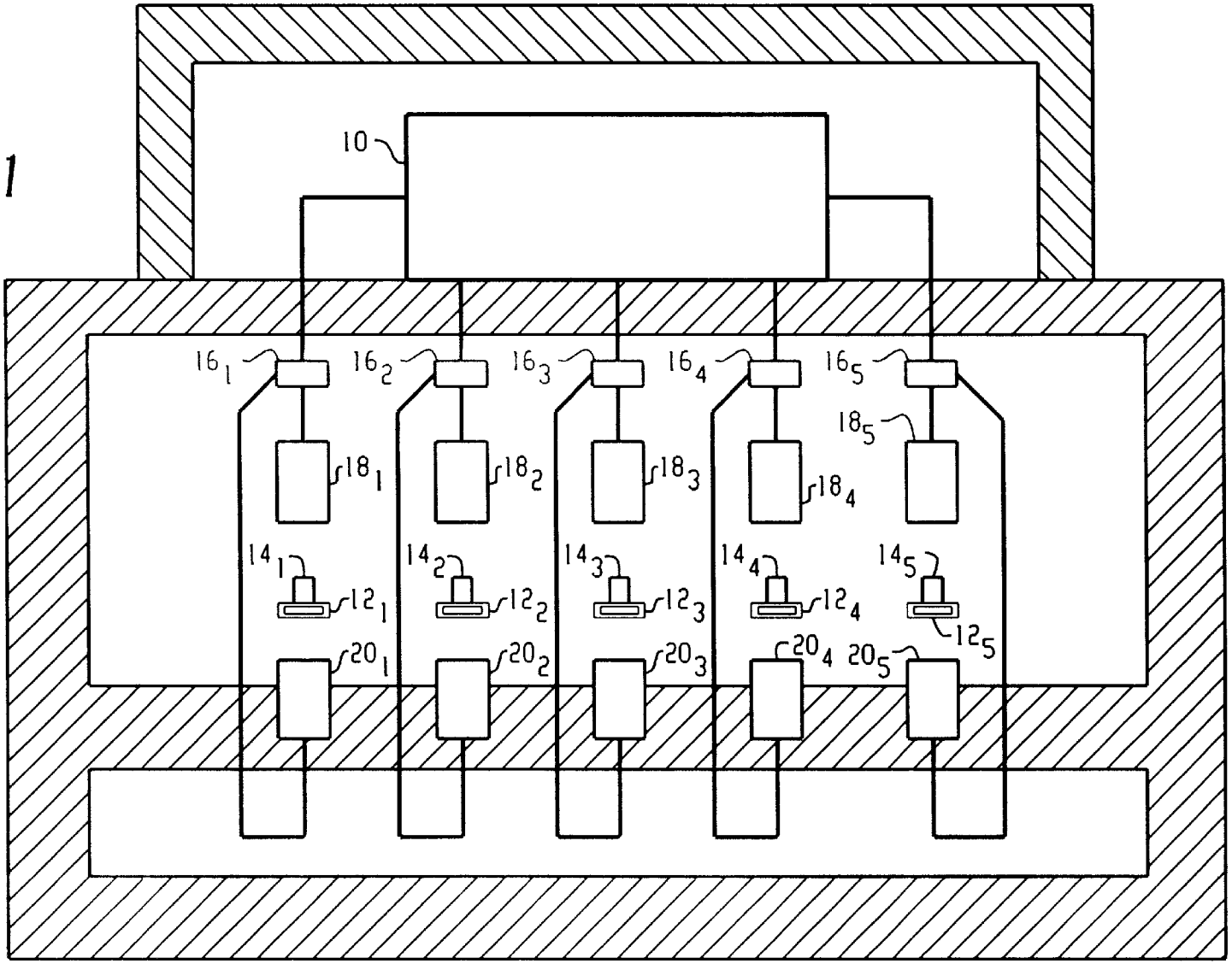
FIG. 1 is a cross sectional view of a product conveyer system in accordance with the present invention.

With reference to FIG. 1, an electron accelerator 10 produces electrons for use in a product irradiation process. In the preferred embodiment, the electron accelerator 10 is a rotary accelerator with electron potential capabilities from 1 to 10 MeV in integer values.

The accelerator 10 supplies electrons for a plurality of scan horns. In the illustrated embodiment, five conveyers $\mathbf{12}_1$, $\mathbf{12}_2$, $\mathbf{12}_3$, $\mathbf{12}_4$, and $\mathbf{12}_5$, convey products or containers of products $\mathbf{14}_1$, $\mathbf{14}_2$, . . . , $\mathbf{14}_5$ to be irradiated. Each of five outputs of the accelerator convey accelerated electrons to an electron beam splitter $\mathbf{16}_1$, $\mathbf{16}_2$, . . . , $\mathbf{16}_5$. The beam splitters split the electron beams between an upper or superior scan horn $\mathbf{18}_1$, $\mathbf{18}_2$, . . . , $\mathbf{18}_5$ and a lower or inferior scan horn $\mathbf{20}_1$, $\mathbf{20}_2$, . . . , $\mathbf{20}_5$. The scan horns scan an electron beam back and forth across the product to irradiate its full width. The electrons from the upper scan horn deposit the majority of their energy in an upper portion of the product or package and a minimal portion in a lower portion. Conversely, electrons from the lower scan horn deposit most of their energy in the lower portion of the product and a minor portion of their energy in the upper part of the product. The energy of the electrons sent to each scan horn pair is selected in relationship to the thickness and density of the irradiated product, such that a substantially equal amount of energy is deposited by the electrons in all parts of the product. Products which are thin or have little density are connected with a lower energy output of the accelerator, such as a 2 or 3 MeV output. Thick, dense products are irradiated with higher electrons, such as 10 MeV electrons.

Figure 2:
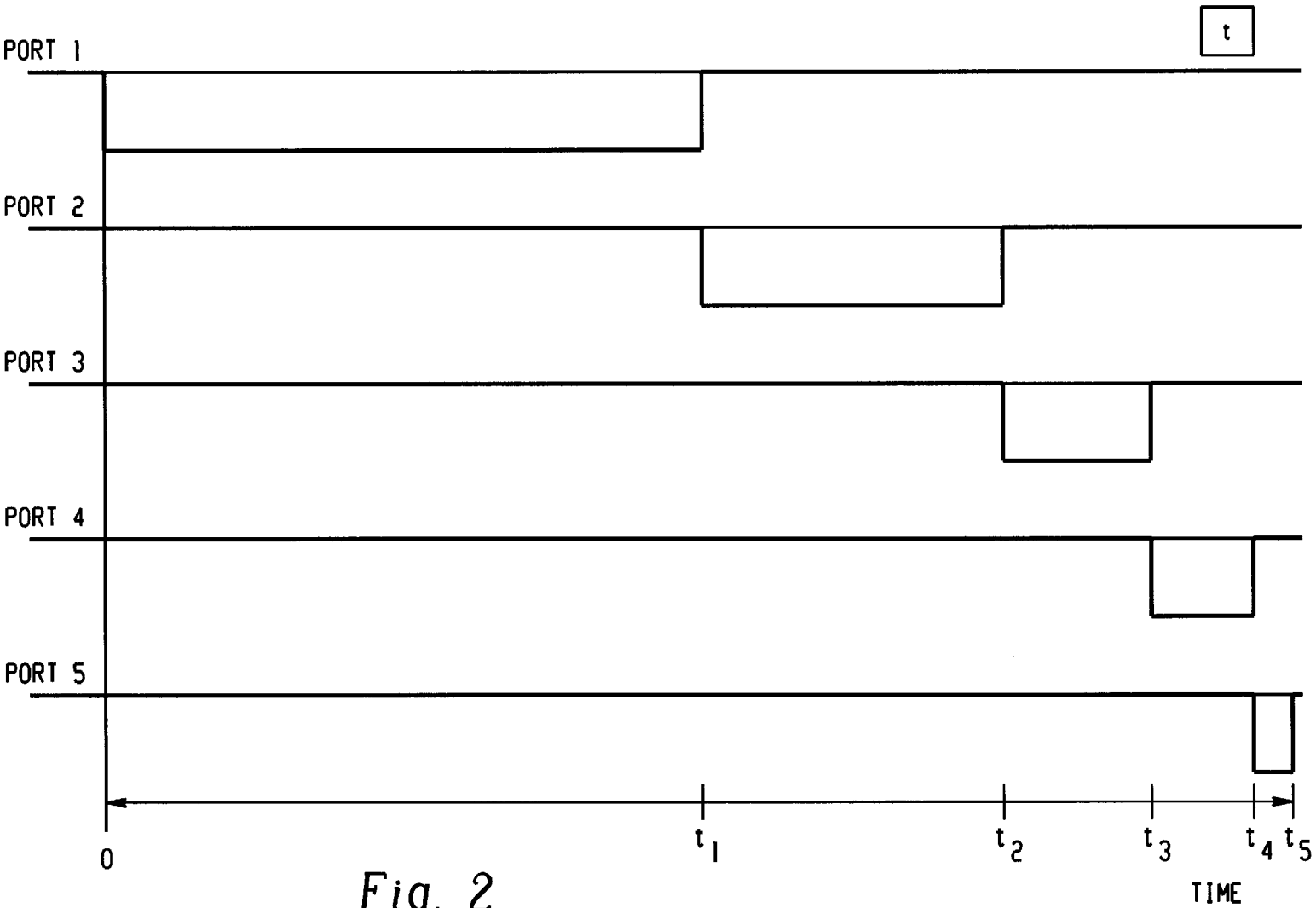
FIG. 2 is a graph of port activity vs. time.

With reference to FIG. 2, a rotary accelerator typically generates electrons at only one of its output ports at a time. When products are to be irradiated with substantially the same amount of energy, electrons are gated from the lowest energy port for relatively long time, $t_1$. Electrons from the next energy port are gated for a shorter time period $t_2$–$t_1$. Similarly, each higher energy output port is gated to produce electrons for progressively shorter period of time. Of course, the duration which electrons are gated to each scan horn varies with the amount of energy that it is desired to deliver to each product. The duration of a cycle among all of the active scan horns is very short compared to the speed of the conveyers, such that all of the product is irradiated without gaps.

Although FIGS. 1 and 2 illustrate using five output ports of the accelerator, it is appreciated that larger or smaller numbers of ports can also be utilized.

Figure 3A:
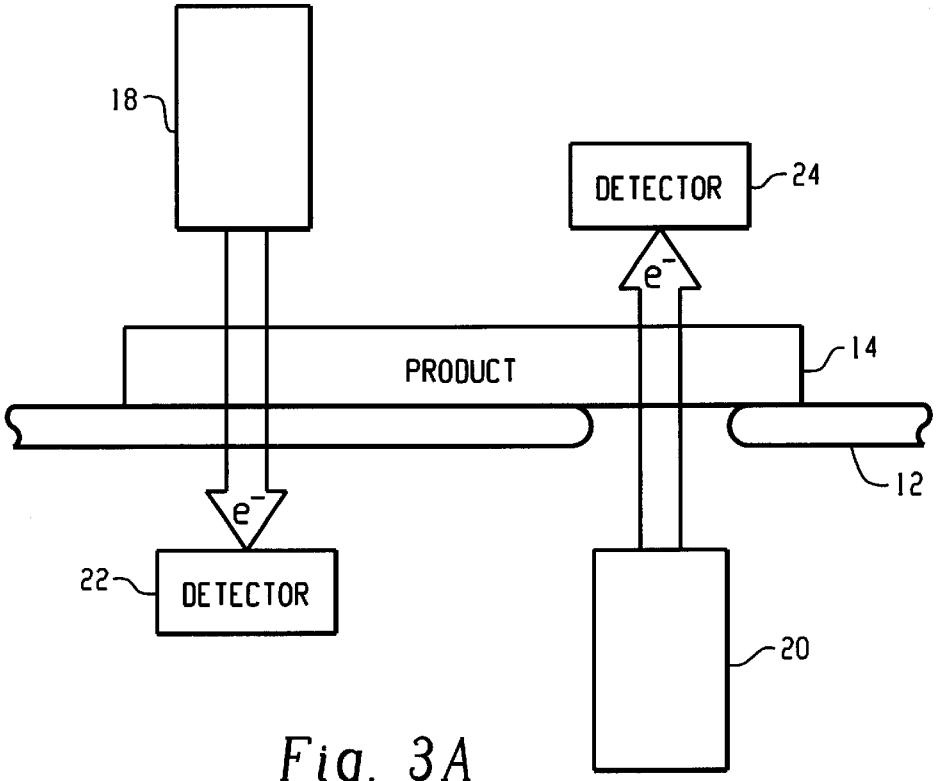
FIG. 3A is a view of a scan horn pair in accordance with the present invention.

With reference to FIG. 3A, preferably, detectors 22, 24 are disposed opposite each of the scan horns to sense the strength of the e-beam emerging from the far side of the product. The energy of the electron beam leaving the scan horn is substantially the same as the known energy of the electron beam generated by the accelerator. By knowing the strength, preferably the energy, of the electron beam emerging from the product, the amount of energy deposited in the product is readily determined.

Figure 3B:
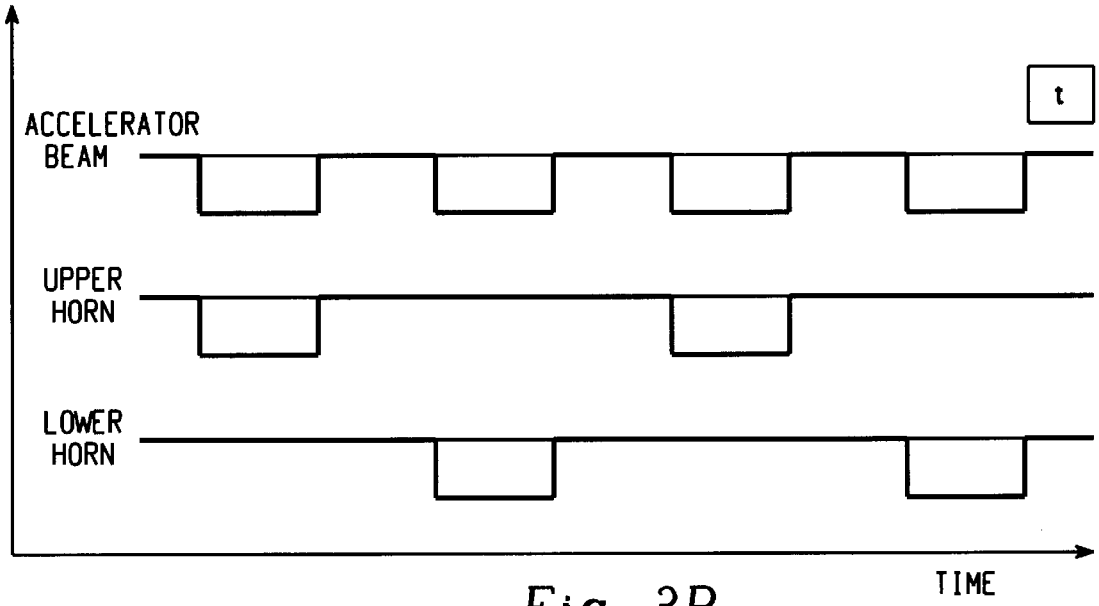
FIG. 3B is a graph of scan horn activity vs. time.

With reference to FIGS. 3*a* and 3*b*, the upper scan horn 18 and the lower scan horn 20 need not be directly opposite each other. Indeed, offsetting the scan horns reduces incidental heat build-up in the product. As illustrated in FIG. 3*a*, the conveyer 12 has a gap between conveyer sections such that the lower scan horn can radiate the product directly without losing energy to the conveyer. As illustrated in FIG. 3*b*, the accelerator only outputs electrons to the illustrated pair of scan horns intermittently, ie. there is a pulsed accelerator beam. In the illustrated embodiment, the pulses are alternated between the upper and lower scan horns. This again reduces heat build-up in the product.

Figure 4:
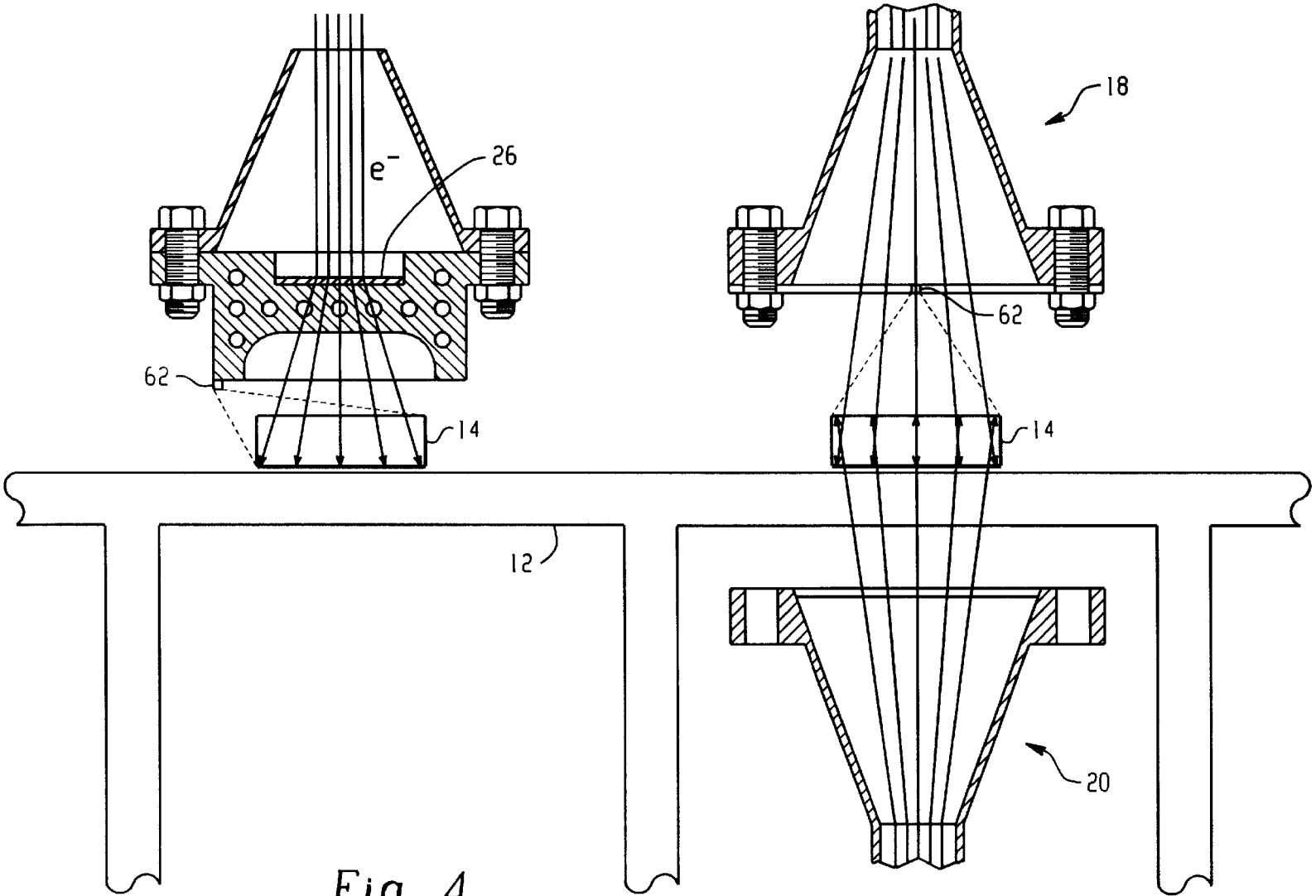
FIG. 4 is a view of a scan horn pair and an x-ray target in accordance with the present invention.

As illustrated in the embodiment of FIG. 4, some of the scan horns produce x-rays and others produce electron beams. X-rays and electron beams can be produced on adjoining conveyer lines. Alternately, the same product can be irradiated sequentially with both types of radiation.

To generate x-rays, an x-ray target 26, such as thin layer of metal with a high z, is mounted in the output face of the scan horn. Electrons which strike the target are converted into x-rays or γ-rays and waste heat. The scan horn window, preferably, includes cooling passages for removing the waste heat.

The type of radiation is chosen, either x-ray or electron beam. This factor is based on the desired density and distribution of the radiation. X-ray radiation will provide a substantially even distribution of energy transfer along its path, making it useful for more voluminous objects. Electron beam, on the other hand, is useful for high doses with low penetration. For instance, if a product was known to be sterile, but had been handled. The electron beam would be selected for surface sterilization. If a thick chub of ground beef were to be sterilized, x-ray would normally be selected to sterilize the whole volume.

An appropriate electron energy is then selected. In the preferred embodiment, the Rhodotron is capable of producing from 1 to 10 MeV electrons, in 1 MeV increments. If using electron beam radiation, the higher energy electrons will deposit more energy in the product and have more sterilizing power. However, when irradiating food, it is possible to change the properties (namely taste) of the food by over irradiation. There is a balance between under-irradiation (not enough to sterilize the product) and over irradiation (altering taste).

Figure 5:
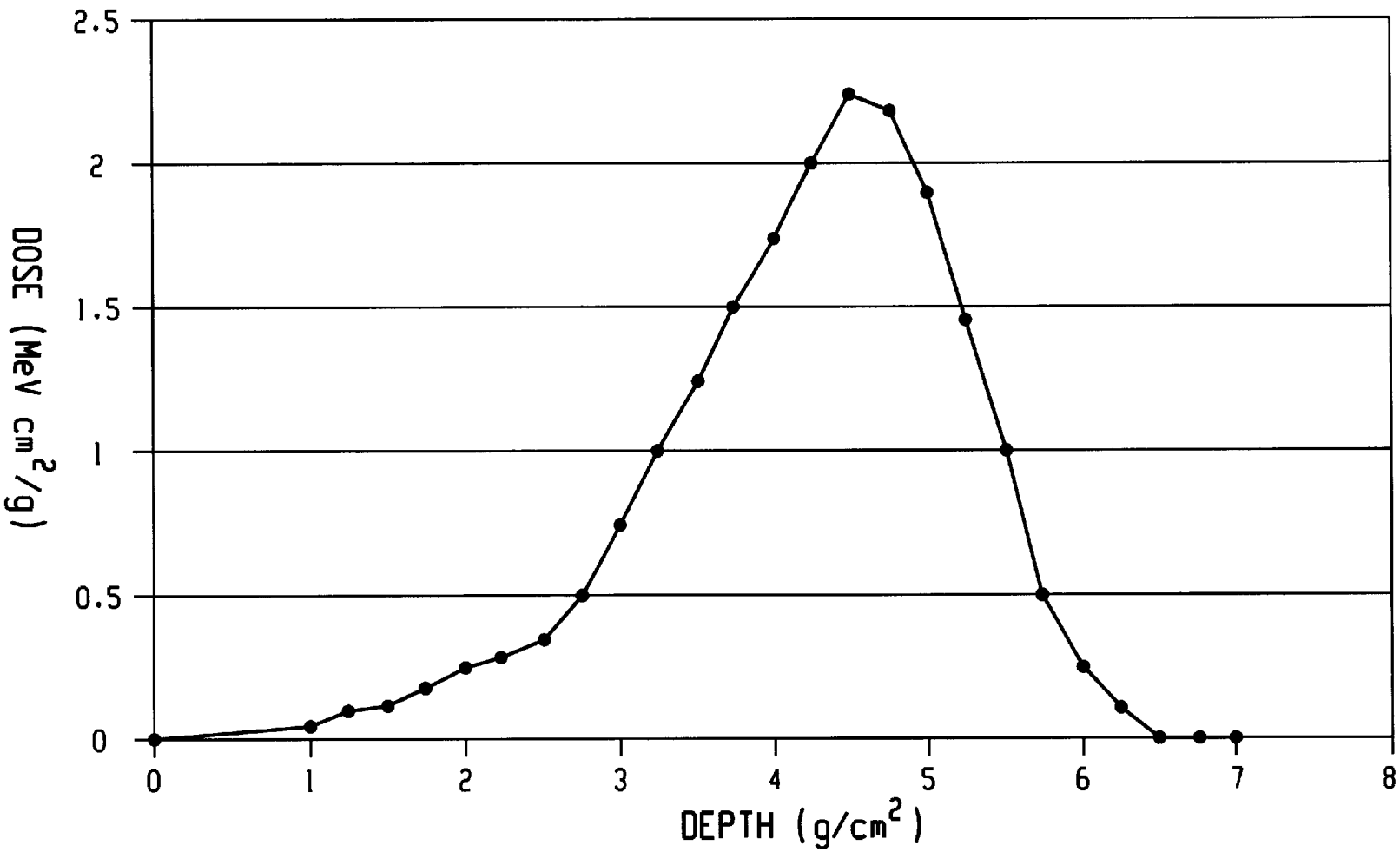
FIG. 5 is a graph of deposited energy vs. depth of accelerated electrons.

A property of electron beam radiation is that most of the kinetic energy of the beam is deposited near the end of its path, as illustrated in FIG. 5 for a 10 MeV beam. Penetration is, of course, less for lower energy beams. This property is useful for lower energy electrons in surface sterilization or treatment. It is also useful in targeting specific areas with higher energy electrons. For example, if more bacteria were present in the creme filling of a Twinkie than in its outer sponge cake, the electron energy is selected such that most of the energy is deposited in the center of the Twinkie, thus, sterilizing the creme filling without over irradiating the sponge cake.

If x-rays are selected, then the selected electron potential effects the energy of the output x-rays. The higher the energy, the wider the spectrum of x-rays. For instance, if electrons having a kinetic energy of 2 MeV are selected, then x-rays are generated with kinetic energies of up to 2 MeV. No x-rays with energies greater than 2 MeV are produced. If 10 MeV electrons are selected, a much wider spectrum of x-rays will be produced up to 10 MeV. Higher energy x-rays have more sterilizing capacity. On the other hand, the higher energy electrons will produce more unwanted heat in the target 26 than lower energy electrons. So again, there is a balance.

The appropriate conveyer 12 speed is selected. The faster product 14 moves through, the less radiation it will receive. This variable can be used as a dose adjustment, faster for less radiation, slower for more. It can also be used as an independent variable, such as to determine a throughput of product. The other variables are adjusted to give the appropriate dose with the selected conveyer speed.

More than one pass can be selected. Additional radiation is received in subsequent passes. If sufficient doses of radiation are not, available in the first pass, then the conveyer 12 reroutes the product around for another pass through the radiation. Optionally, the product can be transferred to another conveyer for irradiation with a different intensity of radiation.

The intensity of the electrons is selected. In electron beam mode, a greater number of electrons per unit time means more sterilization power. In x-ray mode, the more electrons per unit time that impinge upon the target 26 the more x-rays are produced. Again this puts additional energy into the product.

Figure 6:
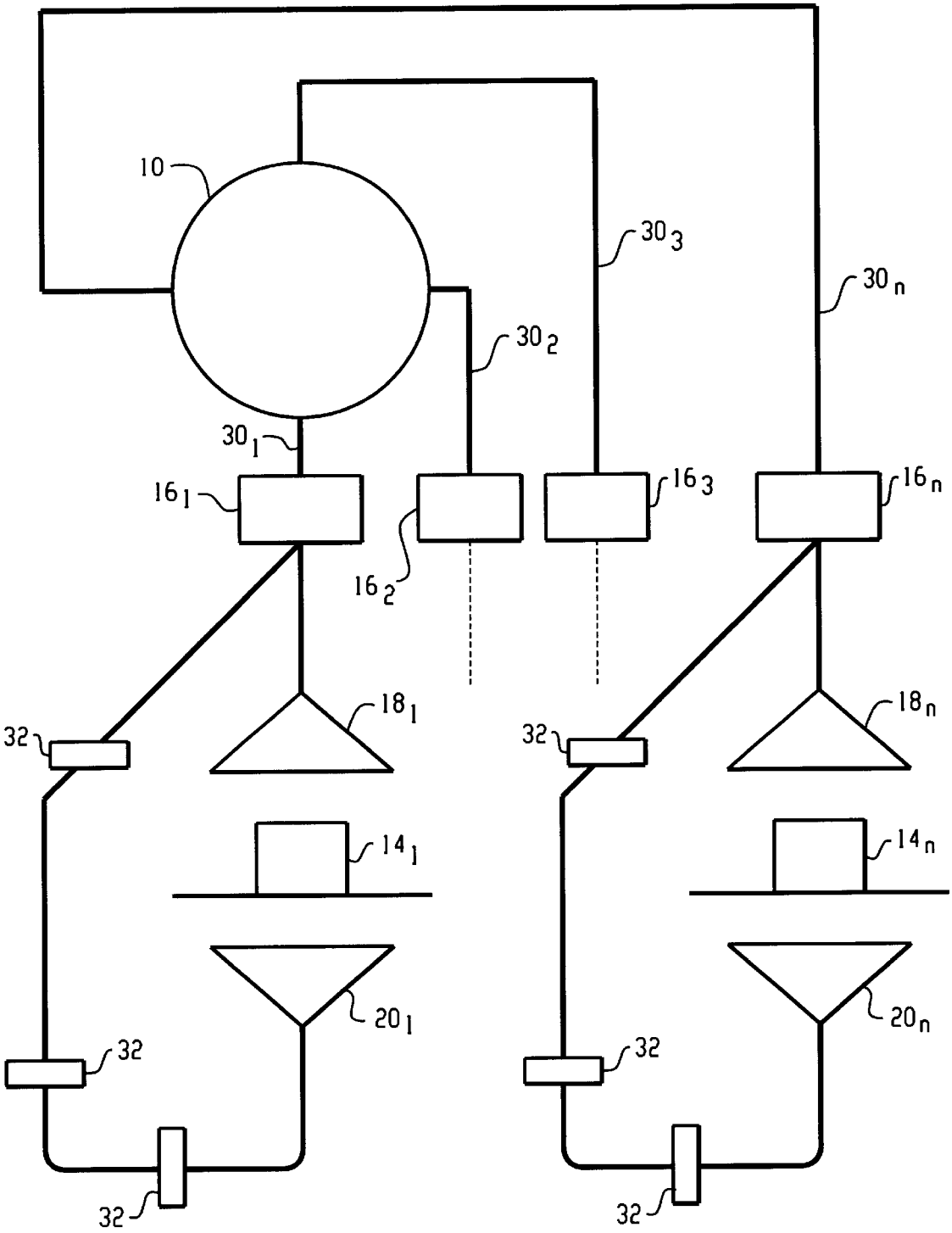
FIG. 6 is a diagrammatic view of two scan horn pairs.

With reference to FIG. 6, the rotary accelerator 10 accelerates electrons which are output to a plurality of beam lines $\mathbf{30}_1$, $\mathbf{30}_2$, . . . , $\mathbf{30}_n$. Each of the beam lines includes a deflector $\mathbf{16}_1$, $\mathbf{16}_2$, . . . , $\mathbf{16}_n$ which splits the electron beam between two distribution lines. One of the distribution lines goes to the upper horn $\mathbf{18}_1$, . . . , $\mathbf{18}_n$ where the electron beam is electrostatically or magnetically swept back and forth over a distance commensurate with the transverse dimension of the package $\mathbf{14}_1$, $\mathbf{14}_n$ being irradiated. The other half of the electrons are conveyed through the evacuated beam lines and deflected by magnetic or other deflectors 32 deflect the electron beam, maintaining its centered in beam lines to the lower scan horn $\mathbf{20}_1$, $\mathbf{20}_n$.

Figure 7:
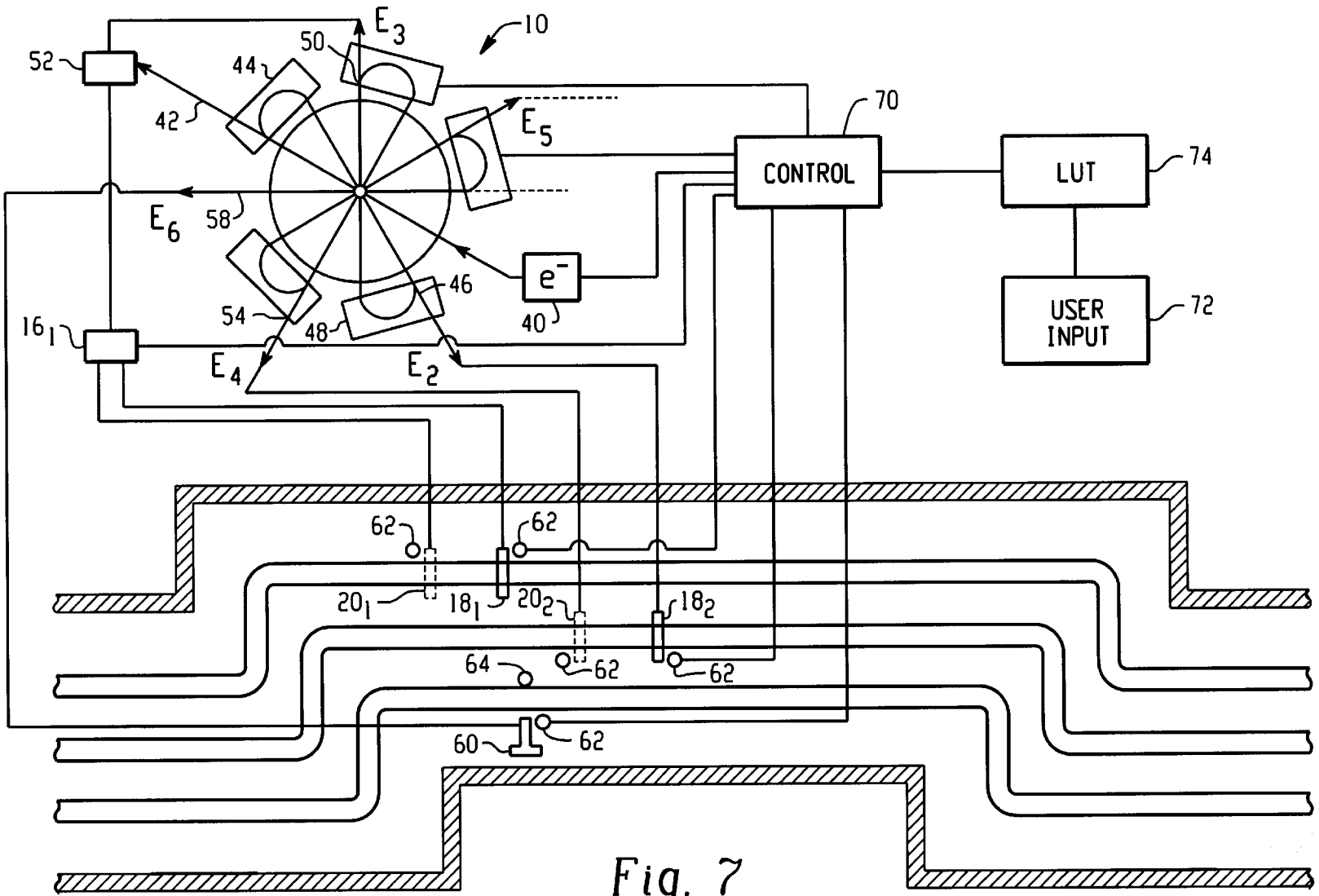
FIG. 7 is a top view of a conveyer system in accordance with the present invention.

With reference to FIG. 7, the accelerator 10 includes a source of electrons 40. Electrons from the source are passed into the accelerator, such as a Rhodotron accelerator which uses RF fields to accelerate electrons in steps in successive passes across its accelerating gap, and either discharged at a low energy port 42, e.g. a 1 MeV port, or deflected by a magnet 44 for another pass through the accelerating gap. After a second pass through the accelerator, the higher energy electron beam, for example 2 MeV, is either passed out of a second output port 46 or deflected by another magnet 48 for another pass through the accelerating gap.

This process is repeated forming a beam with kinetic energy of the electrons to various selected kinetic energy levels, six in the illustration of FIG. 7. In the embodiment of FIG. 7, the lowest energy electrons are split with a beam splitter $\mathbf{16}_1$ and channeled to a overhead scan horn $\mathbf{18}_1$ and a lower scan horn $\mathbf{20}_1$. When electrons of a higher kinetic energy are wanted, the output of one of the higher energy ports 50 is channeled through an intersection or beam path combiner 52 to the beam splitter $\mathbf{16}_1$. For treating items on a second conveyer line $\mathbf{12}_2$ differently, electrons of the second energy level from the output port 46 and electrons from a higher energy level output port 54 are channeled to a pair of scan horns $\mathbf{18}_2$ and $\mathbf{20}_2$. The pair of scan horns can be disposed over and under the conveyer system, both on the same side, or the like. Analogously, one or both of the scan horns can be fitted with an x-ray target for converting the electrons into x-rays. Electrons from another output port 58, such as the highest energy output port, are conveyed to a scan horn 60, which is mounted to project the electrons horizontally. Again, the scan horn 60 can include an x-ray target for converting the electrons into x-rays. Similarly, the scan horn 60 can be positioned over, under, or in other locations relative to the conveyer $\mathbf{12}_n$. Various other combinations of scan horns for electrons and x-rays and various other scan horn positionings are contemplated. Optionally, a radiation intensity detector 64 is positioned across the radiation region from one or more of the scan horns to sense the level of radiation on the other side of the product. From the difference of radiation in and out, the dose or amount of absorbed radiation is readily determined.

In order to control the dose uniformly, a control circuit 70 controls the electron source 40, the accelerator 10 including the magnets at the exit port to send pulses of electrons, similar to FIG. 2, out the various used ports. Preferably, the electrons are only cycled to the ports that are connected with scan horns under which product is being conveyed. The controller 70, preferably, also controls the speed of the conveyers, as necessary to control dose. More specifically, the user inputs dose and conveyer speed requirements through user input device 72. The appropriate energy level and pulse duration to deliver the selected dose is identified in a look up table 74. The control circuit 70 then controls the delivery of electrons to each scan horn in accordance with the criteria from the look up table. If the electron delivery criteria indicates that adequate dose cannot be delivered at the selected conveyer speed, the controller 70 reduces the conveyer speed and provides a visual indication of this reduction to the user.

In the preferred embodiment, there are optical or other sensors 62 that sense when the product 14 is in the irradiation region. The sensors 62 are coordinated with the electron accelerator 10 such that the irradiation region is only irradiated when there is product present.

A similar sensor is also used in conjunction with the x-ray target 26. The sensor helps extend the life of the target. By toggling the electrons on and off, the target is only intermittently heated to promote cooling.

There can be as many scan horn pairs as there are energy levels. Or a plurality of energy levels can be selectively channeled to one scan horn pair.

In an alternate embodiment, there are as many accelerators as scan horns or scan horn pairs. Linear accelerators of the same or different energy are contemplated.

In another alternate e-beam embodiment, two scan horns are always selected, and other variables are adjusted accordingly. Likewise, other variables can be held constant, conveyer speed, number of passes, etc. and the rest of the variables adjusted to compensate.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

Having thus described the preferred embodiments, the invention is now claimed to be:

1. A product irradiation system comprising:

a shielded room;

a means for conveying a plurality of products concurrently through the shielded room;

a plurality of scan horns, at least one scan horn positioned for directing radiation into products conveyed on a corresponding conveyer;

an electron accelerator means for accelerating electrons to concurrently create a plurality of accelerated electron beams of different kinetic energies, the electron accelerator means including:

a means for accelerating electrons to a first level of kinetic energy, a means for accelerating the first kinetic energy electrons to a second level of kinetic energy, a means for accelerating the second kinetic energy electrons to a third level of kinetic energy, a means for cyclically discharging pulses of beams of the first, second, and third levels of kinetic energy electrons;

a control means for directing the first, second, and third kinetic energy electron beams among the scan horns, such that each scan horn irradiates products with electrons of a one of the first, second, and third kinetic energies.

2. A product irradiation system comprising:

a shielded room;

a conveyer for conveying a plurality of products concurrently through the shielded room;

a first scan horn positioned for directing radiation into products conveyed on the conveyer;

a second scan horn positioned for directing radiation into the products conveyed on the conveyer, the first and second scan horns being positioned on opposite sides of the product to irradiate the product from opposite directions;

an electron accelerator for accelerating electrons to create both a first accelerated electron beam of a first kinetic energy and a second accelerated electron beam of a second kinetic energy different from the first kinetic energy;

a control for directing the first electron beam to the first scan horn and the second electron beam to the second scan horn to, to irradiate product concurrently with electron beams of different kinetic energies.

3. The product irradiation system as set forth in claim 2, wherein at least one of the scan horns include a heavy metal target for converting electron beam into x-rays.

4. A product irradiation system comprising:

a shielded room;

a plurality of conveyers for conveying a plurality of products concurrently through the shielded room;

at least two scan horns disposed to irradiate product on one of the conveyers, the two scan horns being offset from each other, such that each irradiates a different portion of the product;

an electron accelerator for accelerating electrons and emitting beams of electrons accelerated to at least two different energies;

a control for directing the electron beams concurrently to the scan horns, such that each of the scan horns irradiates the products with electron beams of one of the at least two energies.

5. The product irradiation system as set forth in claim 4, wherein the two scan horns are disposed on opposite sides of the product.

6. The product irradiation system as set forth in claim 5, wherein the controller directs electrons to the oppositely disposed scan horns alternately.

7. A product irradiation system comprising:

a shielded room;

a plurality of conveyers for conveying a plurality of products concurrently through the shielded room;

a plurality of scan horns, at least one scan horn positioned for directing radiation into products conveyed on a corresponding conveyer;

an accelerator with output ports for generating electrons of each of a plurality of levels of kinetic energies, the scan horns receiving electrons of different kinetic energies;

a control for distributing the electrons of the plurality of energies among the scan horns, such that each of the scan horns irradiates product with electrons of selected energy.

8. The product irradiation system as set forth in claim 7, further including:

a product sensor for sensing when products are being irradiated, the sensor being connected with the controller such that the electrons are only distributed among the scan horns which are currently irradiating product.

9. The product irradiation system as set forth in claim 4, further including a radiation detector disposed on an opposite side of the product from at least one of the scan horns for detecting an amount of received radiation, the radiation detector being connected with the controller.

10. The product irradiation system as set forth in claim 7, wherein at least some of the scan horns include a heavy metal target for converting the accelerated electrons into x-rays.

11. A product irradiation system comprising:

a shielded room;

a plurality of conveyors for conveying a plurality of products concurrently through the shielded room;

a plurality of scan horns, at least one scan horn positioned for directing radiation into products conveyed on each corresponding conveyer;

an electron accelerator for accelerating electrons to concurrently create a plurality of accelerated electron beams, each beam having electron pulses of characteristic electron kinetic energy and pulse duration;

an operator accessible control system that accesses a look up table to retrieve pre-determined beam characteristic values for optimum irradiation based on a user input dose input information for each conveyor, the values including:

the electron kinetic energy;

the electron beam pulse duration;

an electron beam repetition rate; and a conveyer speed.

12. A method of irradiation comprising:

conveying products through an irradiation shielded region;

generating a plurality of beams of high kinetic energy electrons including:

generating electrons, accelerating the generated electrons to a first level of kinetic energy, accelerating the first level of kinetic energy electrons to a second, higher level of kinetic energy, accelerating the second level of kinetic energy electrons to a third, higher level of kinetic energy;

concurrently scanning the accelerated electrons of at least two of the kinetic energy across the conveyed products.

13. The method as set forth in claim 12, further including converting at least some of the accelerated electrons to x-rays.

14. The method as set forth in claim 12, wherein the accelerated electrons irradiate opposite sides of the conveyed product alternately.

15. The method as set forth in claim 12, wherein the accelerated electrons are formed into a pulsed beam.

16. The method as set forth in claim 12 further including:

concurrently directing electrons of one of the energy levels to scan one conveyed product and electrons of a different one of the kinetic energy levels to scan another conveyed product.

17. A method of irradiation comprising:

passing a plurality of products on lines through an irradiation shielded region;

generating beams of higher kinetic energy electrons and beams of lower kinetic energy electrons;

dividing at least some of the beams into a pair of beams; and, scanning the electron beams across each line of products to be irradiated, with at least one of the pairs of beams irradiating a common product from opposite sides.

18. A method of irradiation comprising:

passing lines of products through an irradiation shielded region;

accelerating electrons to different kinetic energies;

dividing the accelerated electrons among a plurality of pulsed beams, at least some of the beams having electron pulses of different kinetic energy than other beams;

concurrently scanning the electron beams of different kinetic energy across the lines of products to be irradiated.

19. A method of irradiation comprising:

conveying products through an irradiation shielded region with different selected doses of radiation;

generating at least higher energy electron beams with pulses of higher kinetic energy electrons and lower energy electron beams with pulses of lower kinetic energy electrons;

controlling the dose by selecting:

a conveying speeds, one of the higher and lower energy electron beams, an electron pulse duration for each beam, concurrently scanning the higher and lower energy electron beams across the conveyed products to be irradiated.

20. A method of product sterilization including:

manually inputting a product type into a product sterilization control;

assigning corresponding values to variables according to product thickness and type;

feeding the product through the sterilization system;

generating an electron beam;

controlling a kinetic energy of the electron beam according to the assigned variables;

irradiating the product with the electron beam.

* * * * *